US005122063A

United States Patent [19]

Cooper

[11] Patent Number: 5,122,063

[45] Date of Patent: Jun. 16, 1992

[54] ADJUSTABLE ELECTRICAL CONNECTOR

[75] Inventor: Gershon N. Cooper, Encino, Calif.

[73] Assignee: Alliance Research Corporation, Chatsworth, Calif.

[21] Appl. No.: 651,469

[22] Filed: Feb. 6, 1991

[51] Int. Cl.[5] ..... H01R 39/00

[52] U.S. Cl. ..... 439/13; 403/96

[58] Field of Search ..... 439/13, 14, 17-19, 439/29; 403/93, 95, 96; 285/184

[56] References Cited

U.S. PATENT DOCUMENTS

| | | | |
|---|---|---|---|
| 639,765 | 12/1899 | Phipps | 403/96 |
| 729,432 | 5/1903 | Sidway | 403/96 |
| 1,358,756 | 11/1920 | Kozlowski | 211/163 |
| 2,013,507 | 9/1935 | Schwarz | 439/318 |
| 2,191,348 | 2/1940 | Lauterbach | 403/93 |
| 2,501,581 | 3/1950 | Rieger | 16/143 |
| 2,503,281 | 4/1950 | Lynch et al. | 285/184 |
| 3,064,998 | 11/1962 | Syverson | 285/184 |
| 3,119,591 | 1/1964 | Malecki | 248/282 |
| 3,170,738 | 2/1965 | Winfree | 308/135 |
| 3,462,112 | 8/1969 | Bracket et al. | 248/349 |
| 3,950,027 | 4/1976 | Wilson | 297/416 |
| 3,977,637 | 8/1976 | Newton | 248/514 |
| 4,026,614 | 5/1977 | Neder | 308/189 R |
| 4,339,844 | 7/1982 | Shatters | 16/82 |
| 5,022,861 | 6/1991 | Aoto | 439/13 |

FOREIGN PATENT DOCUMENTS 2392268 12/1978 France .

OTHER PUBLICATIONS

Ora Electronics, catalog, "Antennas, Mounts, and Accessories for Cellular Phones", Winter 1991-Catalog 11.

*Primary Examiner*—Gary F. Paumen

*Attorney, Agent, or Firm*—Marvin H. Kleinberg

[57] ABSTRACT

An electrical connector assembly has base and pedestal members designed to connect an electronic device and accessory, and includes spring-loaded pins cooperating with recesses to maintain a selected rotational position therebetween, while permitting manual rotation of the pedestal member relative to the base member.

15 Claims, 2 Drawing Sheets

ADJUSTABLE ELECTRICAL CONNECTOR

NOTICE REGARDING COPYRIGHTED MATERIAL

A portion of the disclosure of this patent document contains materials that are subject to copyright protection. The copyright owner has no objection to the facsimile reproduction by anyone of the patent document or the patent disclosure as it appears in the Patent and Trademark Office patent file or records, but otherwise reserves all copyright rights whatsoever.

BACKGROUND OF THE INVENTION

1. Field of the Invention

This invention relates in general to electrical connector assemblies, and, more particularly, to an angled electrical connector assembly that is selectively adjustable. yet capable of supporting, in a selected orientation, an electrical circuit element such as an antenna.

2. Description of the Related Art

Electrical connectors are essential components in electrical and electronic circuits acting as interfaces between major modules, equipment or circuits, that is, they provide for the input and output of electrical signals throughout a circuit or in interconnecting various modular pieces of equipment.

One major use of electrical connectors, is in connecting non-permanent circuit elements, such as transmission lines or antenna elements, to the circuit so as to provide an electrical path for electrical signals.

Since the electrical connector assembly is often a separate, external piece that is added to the equipment or circuit to permit the connection of an external, removable element, its overall configuration is important not only from the electrical standpoint, but from the standpoint of providing the most spatially effective shape possible for the particular situation. As a result of the many different kinds of situations in which electrical connectors are found, a number of differing configurations have become standard. Chief among these standard configurations are the straight-through or in-line connector, and the elbow or angled connector. Many times these two configurations are used in conjunction with one another to provide configurations not available as a single connector unit, for example, a U-shaped connector composed of two elbow connectors.

While combinations of various available connector configurations may provide for a large number of situations, such groupings are expensive, large, bulky, and many times fail to provide for non-standard configurations, which, at times, appear to be the norm in real installations.

OBJECTS AND SUMMARY OF THE INVENTION

Accordingly, it is an object of the present invention to provide at least a partial answer to the problem of using an electrical connector in a situation requiring a non-standard configuration.

It is also another object of the present invention to provide a single electrical connector that is selectively adjustable by a user to accommodate varying situations.

It is still another object of the present invention to provide an electrical connector that can be fixedly connected to a piece of equipment on one end, so that it is non-rotatable with respect to the equipment to which it is fixed, and on the other end to an external circuit element, such as an antenna, that will support the antenna element in one of a plurality of selected, but changeable, spatial orientations with regard to the equipment.

In summary, the present invention is embodied in an electrical connector assembly having a base member with a first end fixedly secured to a pedestal member but rotatable relative thereto. The base and pedestal members are connected in a manner that permits the base member to be fixedly connected to a piece of equipment in a non-rotatable relation, so that it has a fixed spatial orientation relative to the equipment to which it is connected, but which permits rotation of the pedestal member, attached to the base member, to a plurality of selected rotational positions relative to the base member, and consequently to the equipment to which the base member is connected.

The novel features of construction and operation of the invention will be more clearly apparent during the following description, reference being had to the accompanying drawings in which is illustrated a preferred form of the device of the invention and in which like characters of reference designate like parts throughout the drawings.

DESCRIPTION OF THE PREFERRED EMBODIMENT

Figure 1:
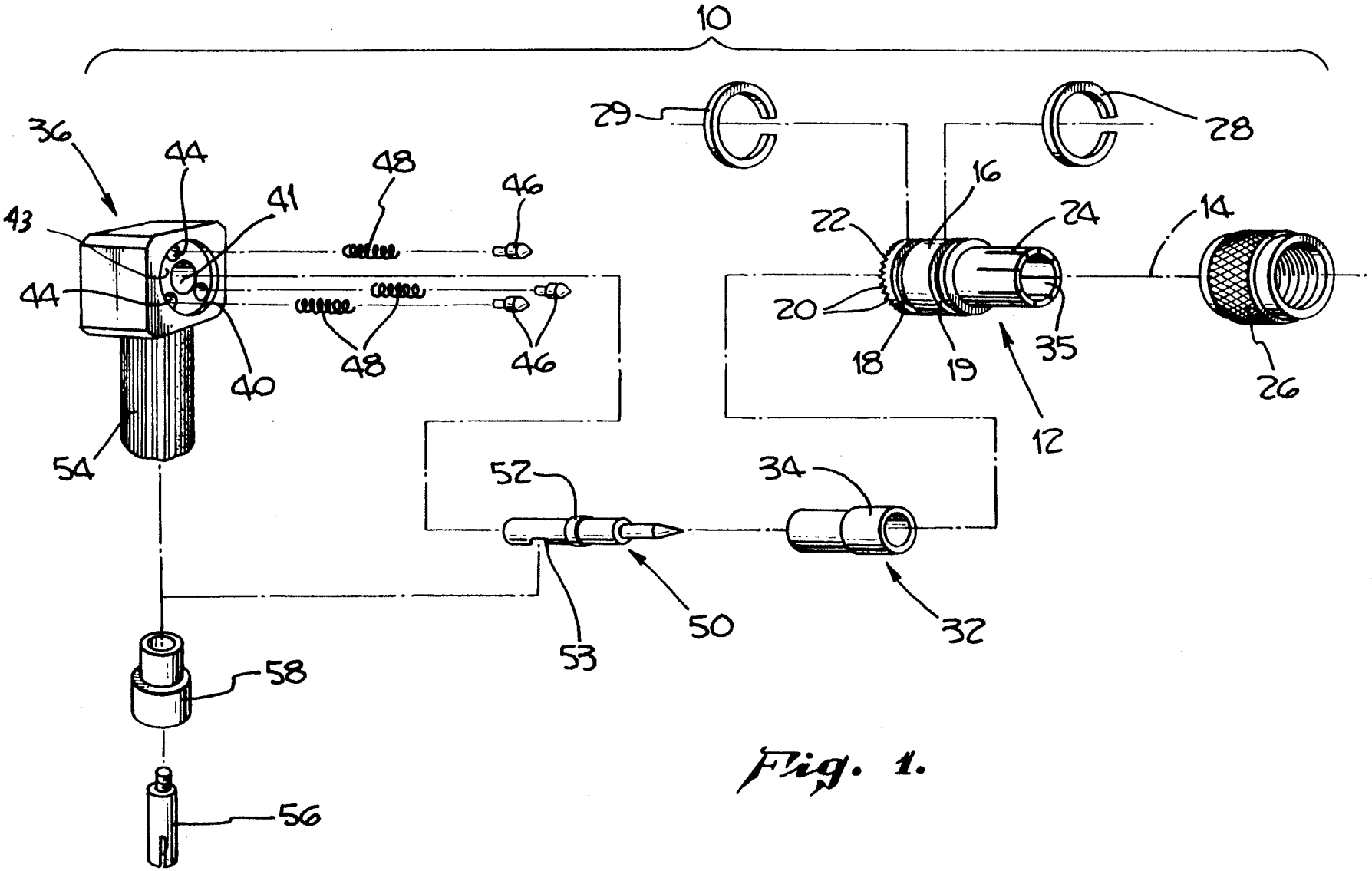
FIG. 1 is an exploded view of an electrical connector assembly according to the present invention.
Figure 2:
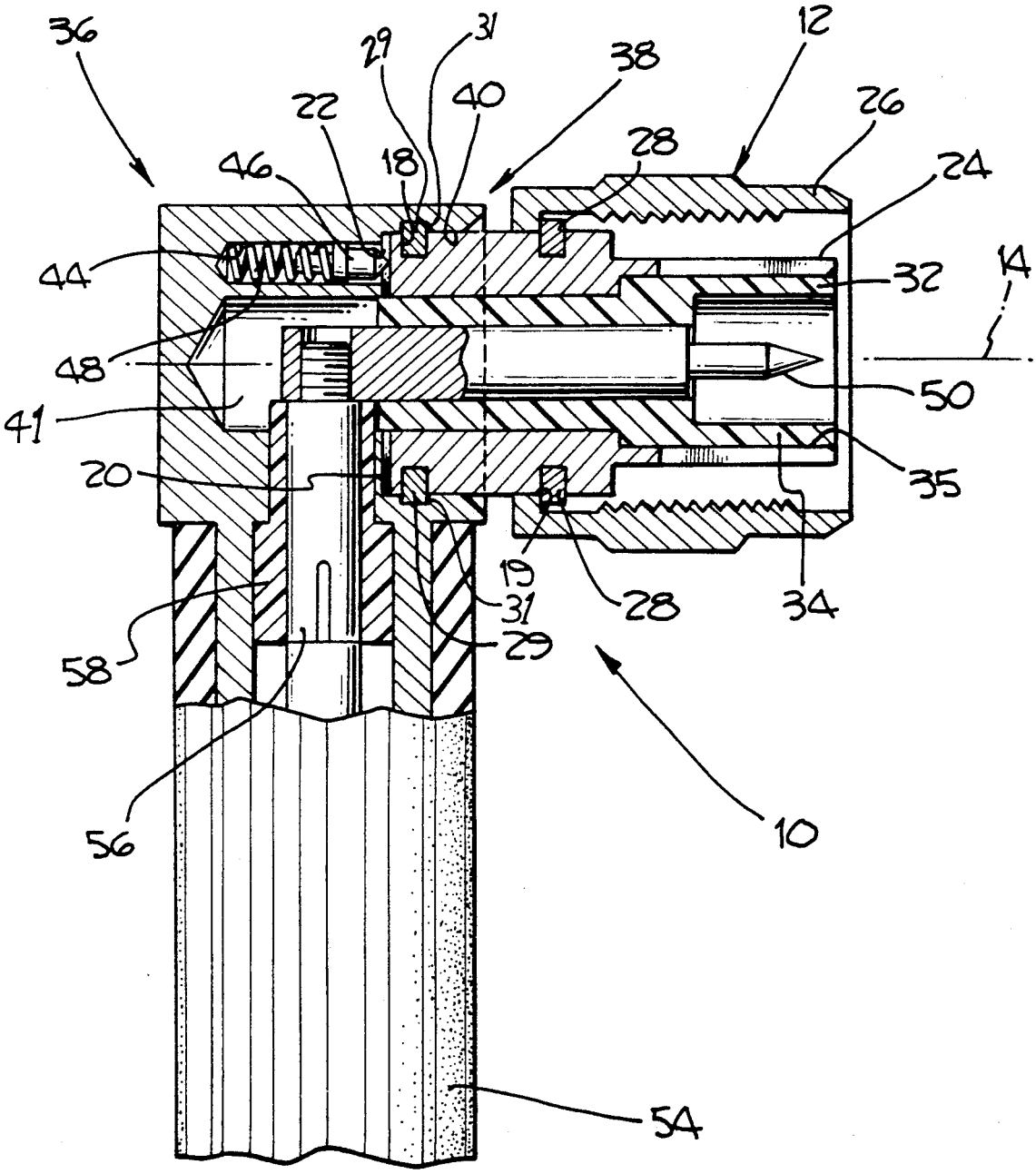
FIG. 2. is a cross-sectional view of an assembled electrical connector of FIG. 1 according to the present invention.

FIG. 1 illustrates an electrical connector assembly 10 embodying the present invention in an exploded view for ease in understanding how the individual components fit together to form the overall assembly 10. While both FIGS. 1 and 2 illustrate the electrical connector assembly 10 constructed in accord with what is commonly referred to as a TNC type connector scheme, other construction schemes including, but not limited to, BNC, DIN, SMA, UHF, Banana plug, RCA, are also contemplated to be embodied in electrical connectors constructed in accord with the present invention.

The connector being described has a base member 12 with a longitudinal axis 14. Base member 12 has a first end 16 and a second end 24. The first end 16 contains a circumferential groove 18 which is used for rotatably mating the base member 12 with the pedestal member 36 as further described below, along with a plurality of first recesses 20 on the end therein arranged in a generally circular pattern concentric to longitudinal axis 14. The second end 24 contains a circumferential groove 19 which is used for rotatably mounting a threaded outer shell 26 as further described below.

The recesses 20 of first end 16 may be indentations in the outer surface of first end 16, or may, as shown, comprise the spaces between a plurality of sawteeth 22 formed in the outer surface of first end 16 concentric with the longitudinal axis 14 and protruding outwardly therefrom. This plurality of recesses 20 are adapted to engage a set of pins 46 retained partially within the pedestal member 36, as better described below, to provide a ratchet-line means for retaining the base and pedestal members 12 and 36 in one of a plurality of selected spatial orientations relative to one another.

In a preferred embodiment, the recesses 20 of the first end 16 are generally uniformly spaced at about 10 degree intervals in a generally circular pattern concentric with longitudinal axis 14. This construction provides 36 recesses for mating with the pin members 46 described below, thus giving the user a range of 12 rotational positional adjustments between the base and pedestal members, although any number of positions are possible depending on the number of recesses 20 formed within the surface of first end 16.

Base member 12 has a second end 24, opposite first end 16, to which an outer shall 26 is rotatably connected that is adapted to threadably mate in a releasable relationship with a separate electrical connector. Illustrated in both FIGS. 1 and 2, is a TNC type connector for a preferred means of threadably mating the second end 24 of base member 12 to an outer circuit. Outer shell 26 is rotatably held to the second end 24 of base member 12 by a retaining ring 28, which fits into the circumferential groove 19 of second end 24.

An insulating connecting tube 32 with collar or thicker end 34 prevents electrical contact between base member 12 and electrically conducting pin 50. The insulating tube 32 with collar 34 is held in a central aperture 35 that is coaxial with the axis 14 and extends through the base member 12. Aperture 35 is wider at second end 24 then first end 16 to accommodate the collar or thicker end 34 of insulating tube 32.

A pedestal member 36 has a mounting end 38 rotatably secured to base member 12, preferably by means of a retaining ring 29 which fits into circumferential groove 18 in the first end 16, and an inner circumferential groove 31 formed within an inner recess 40 of the mounting end 38. However, any of the commonly used methods of securing two members may be used as the particular situation may warrant for ease in manufacturing. A portion of the insulating tube 32 containing conducting pin 50 fits into a central aperture 41 formed in the pedestal member 36

As a result of the rotational coupling of base member 12 within pedestal member 36, there is very limited longitudinal axial movement, and a fixed space is provided between the base member 12 and the inner surface 43 of the pedestal member 36 to allow the pins 46 to interact in locking and unlocking fashion with the recesses 20 of the base member 12. The inner surface 43 of the pedestal member 36 has at least one second recess 44 therein that is at the same radial distance from the longitudinal axis 14 as are the first recesses 20 of the base member 12. While a single second recess 44 is adequate for operation, it is preferred that second mounting surface 38 have at least three second recesses 44 formed therein at about 120 degree intervals in a generally circular pattern as illustrated in FIG. 1.

Second recesses 44 are preferably arranged symmetrically with respect to longitudinal axis 14, and are adapted to register with successive sets of first recesses 20 when the base and pedestal members 12 and 36 are rotated relative to one another.

There is a separate pin 46 in each of the second recesses 44. Each of the pins 46 preferably has a hemispherical or parabolic head, and all of first recesses 20 are adapted so that pins 46 cannot fully enter first recesses 20. These two features work together to maintain a camming surface between the pins 46 and the first recesses 20 of the base member 12.

There is a spring 48 within each of the second recesses 44 urging its corresponding pin 46 outwardly from its recess 44 so that the head portion of each of the pins 46 normally extends somewhat outwardly from the inner surface 43 of the pedestal member 36, and in retaining engagement with a selected one of the first recesses 20 of the base member 12. Each spring 48 is adapted to press its corresponding pin 46, outwardly with sufficient force to reliably maintain a selected rotational position of the base and pedestal members 12 and 36 relative to one another that is not overcome by torque forces resulting from the connection of the pedestal member 36 to a circuit element, such as an antenna, that is laterally displaced from the base member 12. However, the retaining force supplied by the spring/pin combination permits manual rotation of the pedestal and circuit element with respect to the base member 12 to achieve one of several selected operating positions.

As an example, fixedly connecting the base member 12 to a piece of equipment, and the pedestal member 36 to an antenna element, would permit both rotation of the antenna element relative to the piece of equipment, and the retention of the antenna element in the selected rotational orientation without disturbing the base member and its circuit connection.

For additional flexibility in accommodating differing situations, it is preferred that the longitudinal axes of the base and pedestal members be non-parallel. One preferred orientation of the longitudinal axes of the base and pedestal members, is that they be generally orthogonal to one another, although non-orthogonal angles are also contemplated. As an example of the latter, an in-line configuration would be useful where the pedestal member is connected to a rotating element and the base member is fixedly connected, in a non-rotating relationship, to a piece of equipment. This in-line configuration would prevent twisting, and possible breakage of the two pieces of circuit equipment connected by the electrical connector.

Finally, to complete the electrical connection to the pedestal member, the electrically conducting pin 50, insulated from pedestal member 36 by collar 52, makes electrical contact with whatever electrical equipment is coupled to the base member 12, on one end, and, for example, the base of an antenna connecting rod 56, on the other. A portion of pedestal member 36 is adapted to provide an electrical connector outlet for connection to other circuit members. An example of a preferred electrical connector outlet on pedestal member 36, would be a bayonet type connector, or a twist-and-turn type connector, both standard in the industry, that would permit connection of other circuit elements such as an antenna, or transmission line, or any of the commonly available connector structures such as BNC, TNC, RCA, UHF, Banana plug, etc.

Pedestal member 36 preferably has its end 54 formed into one of the standard connector interfaces such as BNC, TNC, etc. as described above, so as to permit its connection to an antenna, transmission lines, or the like. In the preferred case being presented here, pedestal end 54 is connected to antenna connecting rod 56, which is insulated from the pedestal member 36 by insulating tube 58, analogous to the insulating tube 32 of the base member 12. The antenna connecting rod 56 is threadably mated into the hole 53 of the conducting pin 50.

This embodiment operates to permit the rotation of the radiating element of the antenna assembly relative to the equipment to which base member 12 is connected, while base member 12 remains in a non-rotating relation to the equipment. In this manner, base member 12 may be fixedly attached to a piece of equipment, such as a mobile telephone housing, and the user can rotate the radiating element of the attached antenna assembly to meet changing placements of the mobile telephone housing. For example, the radiating element of the antenna assembly can be rotated downward, out of the way whenever the mobile telephone is not in use, and rotated vertical when the mobile telephone is being used. All of these rotations of the antenna assembly can be done by the user without having to loosen, rotate or otherwise disturb the connection made between the base member 12 and the mobile telephone housing, thus assuring that, once a proper connection is made between the base member 12 and the housing, it need not be disturbed.

The invention described above is, of course, susceptible to many variations, modifications and changes, all which are within the skill of the art. It should be understood that all such variations, modifications and changes are within the spirit and scope of the invention and of the appended claims. Similarly, it will be understood that Applicant intends to cover and claim all changes, modifications and variations of the example of the preferred embodiment of the invention herein disclosed for illustration that are not departures from the spirit and scope of the present invention.

What is claimed is:

1. An electrical connector assembly comprising:

a. a base member having a longitudinal axis and having, at a first end, a plurality of first recesses of limited depth that are arranged in a generally circular pattern concentric to said longitudinal axis, said base member being adapted to couple with an electronic device;

b. a pedestal member having an inner recess and an inner surface therein, said pedestal member being rotatably connected to said base member, there being a fixed space between said first end of said base member and said pedestal member inner surface, i. said inner surface having at least one second recess therein of limited depth that is at the same radial distance from said longitudinal axis as said first recesses, ii. said pedestal member being adapted to couple with an electronic device;

c. a pin having an extended head portion with converging sides in said second recess, all of said first recesses being adapted so that there is a camming surface between said pin and said first recesses;

d. a spring within said second recess for urging said pin outwardly from said recess so that said pin head normally extends somewhat outwardly from said pedestal member inner surface but in retaining engagement with a selected one of said first recesses, said spring being adapted to urge said pin outwardly with sufficient force to reliably maintain a selected rotational position of said base and pedestal members relative to one another that is not overcome by torque forces resulting from the connection of said pedestal member to a circuit element that is laterally displaced from said base, but yet permitting manual rotation of said pedestal member and attached circuit element with respect to said base to a different selected operating position;

f. conductive means electrically isolated from and centrally located in said base member and said pedestal member for conducting electrical energy through the connector so that the free ends of said base member and said pedestal member can be interposed into an electrical circuit.

2. An electrical connector assembly as in claim 1 wherein said plurality of first recesses comprises a plurality of sawteeth formed in said first mounting surface.

3. An electrical connector assembly as in claim 2 wherein said sawteeth are generally uniformly spaced at about 10 degree intervals in a generally circular pattern.

4. An electrical connector assembly as in claim 1 wherein said second mounting surface has three (3) second recesses formed therein at about 120 degree intervals in a generally circular pattern and each of said second recesses contains a pin and spring member.

5. An electrical connector assembly as in claim 1 wherein said base member has a free end opposite said first end containing coupling means for releasably connecting said base member free end to a separate electrical connector of an electronic device for placing the connector assembly into an electrical circuit.

6. An electrical connector assembly as in claim 5 wherein said coupling means includes a threaded mating element rotatably secured to said base member adapted to releasably connect with the separate electrical connector of an electronic device.

7. An electrical connector assembly as in claim 1 wherein the longitudinal axes of said base member and said pedestal member are generally orthogonal to one another.

8. An electrical connector assembly as in claim 4 wherein said second recesses are arranged symmetrically with respect to said longitudinal axis, and are adapted to register with successive ones of said first recesses when said base and pedestal are rotated relative to one another.

9. An electrical connector assembly as in claim 6 wherein said coupling means retains said base member in a non-rotational relation to a housing of a source of electrical signals.

10. An electrical connector assembly comprising:

a. a pedestal member having a longitudinal axis upon which lie the center of an inner recess, an inner surface therein, and a central aperture extending more deeply into the pedestal member therein, and an electrically isolated, conductive pin contained within the central aperture and projecting therefrom for mating with electronic devices that are coupled to said electrical connector, said inner surface having at least one other recess therein which is non-coaxial to said inner recess and central aperture, b. a holding pin and a spring member in said other recess, said spring member urging said holding pin outward from said first recess;

c. a hollow tubular base member, rotatably coupled within said inner recess of said pedestal member, said base member i. having a longitudinal axis coaxial with said pedestal member longitudinal axis, ii. having an axial central aperture in which to receive therethrough, in an electrically isolated manner, the portion of said conductive pin projecting from said pedestal member, said base member and conductive pin having a rotatable relationship, iii. having a plurality of uniformly spaced sawteeth in a generally circular pattern about said longitudinal axis, said sawteeth containing spaces of limited depth therebetween adapted to register said holding pin when said base and pedestal members are rotated relative to one another; and d. connecting means for securing said base and pedestal members to electronic devices;

said holding pin having a converging head adapted to provide a camming surface between said holding pin and said sawteeth spaces; and said spring member biasing said holding pin outward from said other recess into engagement with a space between said sawteeth with sufficient force to reliably maintain a selected rotational position of said base and pedestal members relative to one another that is not overcome by torque forces resulting from the connection of said pedestal member to a circuit element that is laterally displaced from said base, but permitting manual rotation of said pedestal member and the attached circuit element with respect to said base to a different selected operating position while maintaining a continuous electrical path therethrough for electrical signals.

11. An electrical connector assembly as in claim 10 wherein said at least one other recess in said inner surface comprises three recesses formed therein at about 120 degree intervals in a generally circular pattern symmetrically displaced from the longitudinal axis of said conductive pin.

12. An electrical connector assembly comprising:

a. a stationary base member having means to releasably couple said base member to a circuit;

b. a rotatable pedestal member having means to couple said pedestal member to an antenna;

c. means for rotatably connecting said pedestal member to said base member.

d. ratchet-like means for reliably maintaining said base and pedestal members in any of several relatively fixed angular positions;

e. conductive means centrally located in, and insulated from, said base and pedestal members for conducting electrical energy through the connector so that the connector can be interposed into an electrical circuit.

13. An electronic connector assembly as in claim 12 wherein said conductive means comprising a conductive pin contained within a central recess, along a longitudinal axis, contained within said base member and pedestal member, said conductive pin being adapted, on either end thereof, to electrically mate with electrical devices coupled to said base and pedestal members.

14. An electronic connector assembly as in claim 13 further including insulating means comprising a hollow tube made of non-conductive material, said hollow tube being located within said central recess of said base and pedestal members, said insulating means being adapted to receive said conductive pin in a rotatable engagement.

15. An electronic connector assembly as in claim 12 wherein said means for rotatably joining said base member to said pedestal comprises a circumferential groove formed near the end of said base member nearest said pedestal member, an inner circumferential groove within the wall surrounding said pedestal member inner recess, and a retaining ring placed within both circumferential and inner circumferential grooves for holding said base and pedestal members together.

* * * * *